United States Patent [19]

Tassie

[11] 4,397,216

[45] Aug. 9, 1983

[54] FEEDER MECHANISM

[75] Inventor: Douglas P. Tassie, St. George, Vt.

[73] Assignee: General Electric Company, Burlington, Vt.

[21] Appl. No.: 230,564

[22] Filed: Feb. 2, 1981

[51] Int. Cl.[3] ..... F41D 10/06

[52] U.S. Cl. ..... 89/33 CA; 89/33 SF

[58] Field of Search ..... 89/33 BC, 33 CA, 33 SF

[56] References Cited

U.S. PATENT DOCUMENTS

| | | | |
|---|---|---|---|
| 2,453,786 | 11/1948 | Dixon | 89/33 |
| 2,815,699 | 12/1957 | Davis | 89/33 |
| 2,821,888 | 2/1958 | Maillard | 89/33 |
| 2,924,150 | 2/1960 | Maillard | 89/33 |
| 3,230,828 | 1/1966 | Maillard | 89/33 |
| 3,277,787 | 10/1966 | Brieger | 89/33 CA |
| 3,296,930 | 1/1967 | Rocha | 89/33 |
| 3,311,021 | 3/1967 | Reed | 89/33 |
| 3,333,506 | 8/1967 | Henshaw et al. | 89/33 |
| 3,417,657 | 12/1968 | Maillard et al. | 89/33 |
| 3,578,118 | 5/1971 | Wetzel | 192/16 |
| 3,785,242 | 1/1974 | Hartmann | 89/33 CA |
| 3,998,125 | 12/1976 | Hartmann | 89/33 CA |
| 4,004,489 | 1/1977 | Johnson et al. | 89/33 SF |
| 4,119,012 | 10/1978 | Frye | 89/33 SF |

FOREIGN PATENT DOCUMENTS

| | | | |
|---|---|---|---|
| 1018438 | 1/1953 | France | 89/33 CA |
| 115069 | 9/1945 | Sweden | 89/33 SF |

*Primary Examiner*—Stephen C. Bentley
*Attorney, Agent, or Firm*—Bailin L. Kuch

[57] ABSTRACT

A feature of this invention is the provision of side stripping stripper which has a sprocket mechanism disposed on the closed side to positively drive both the rounds of ammunition and the respective links during the stripping operation.

Another feature of this invention is the provision of a mechanism for receiving two feeds of linked ammunition and which has two, mutually interlocked, sprocket mechanisms, each disposed on the closed side of a respective feed of linked ammunition, so that one or the other sprocket mechanism is enabled to positively drive both the rounds of ammunition and respective links during the stripping operation of the selected feed of linked ammunition.

21 Claims, 7 Drawing Figures

FEEDER MECHANISM

BACKGROUND OF THE INVENTION

1. Field of the Invention

This invention relates to feeder mechanisms for high rate of fire guns, and particularly to a sprocket mechanism for side stripping and feeding linked ammunition; and a mechanism incorporating said sprocket mechanism for side stripping and feeding either of two feeds of linked ammunition; and a Gatling type gun for receiving either of two feeds of ammunition.

2. Prior Art

Linked ammunition conventionally consists of a series of rounds of ammunition held in sequence by a series of links or clips. Each link may grasp a single round and be directly engaged to the next link between immediately adjacent rounds, or a link may grasp two immediately adjacent rounds and be indirectly engaged to the next link by the commonly grasped link. To be chambered in the gun the round must be removed or stripped from the link. The stripping action may be carried out radially from the longitudinal axis of the link, called "side stripping," or may be carried out longitudinally, called "push through" stripping. In linked ammunition intended to be side stripped, the train of ammunition has an open side, out through which each round is to be radially passed, and a closed side. The sprocket which engages and as it rotates, advances the train of ammunition, may engage from either the open or the closed side. In either case the sprocket conventionally engages the round, but not the link. The sprocket engages the round and positively pushes it against a fixed tooth or wedge to snap the round out of the link, while the snaped-out-of link is merely advanced along its guides by the next successive link. The result is that the link, during and after stripping, is not positively controlled and may twist or turn as it is loosely pushed along, and, thereupon. jam.

Exemplary side-stripping, open side, sprocket driven strippers are shown in:

- U.S. Pat. No. 2,453,786, issued to P. H. Dixon on Nov. 16, 1948;
- U.S. Pat. No. 2,815,699, issued R. W. Davis on Dec. 10, 1957;
- U.S. Pat. No. 2,821,888, issued to B. Maillard on Feb. 4, 1958;
- U.S. Pat. No. 2,924,150, issued to B. Maillard on Feb. 9, 1960;
- U.S. Pat. No. 3,230,828, issued to B. Maillard on Jan. 25, 1966;
- U.S. Pat. No. 3,311,021, issued to F. P. Reed on Mar. 28, 1967;
- U.S. Pat. No. 3,296,930, issued to J. G. Rocha on Jan. 10, 1967;
- U.S. Pat. No. 3,333,506, issued to R. W. Henshaw et al on Aug. 1, 1967;
- U.S. Pat. No. 3,417,657, issued to B. Maillard et al on Dec. 24, 1968;
- U.S. Pat. No. 4,004,489, issued to C. D. Johnson on Jan. 25, 1977; and
- U.S. Pat. No. 4,119,012, issued to G. Frye on Oct. 10, 1978.

Exemplary side-stripping, closed side, sprocket driven strippers are shown in:

- U.S. Pat. No. 3,785,242, issued to R. Hartman on Jan. 15, 1974; and

- U.S. Pat. No. 3,998,125, issued to R. Hartman on Dec. 21, 1976.

In each of the foregoing patents, the round is positively controlled, but the link is not and may jam.

It is an object of this invention to provide a side stripping, sprocket driven stripper, in which the stripped link is precluded from jamming.

It is another object to provide such a stripper, in which the stripped link is positively controlled.

It is yet another object to provide such a stripper which can strip and feed either of two feeds of linked ammunition.

A feature of this invention is the provision of side stripping stripper which has a sprocket mechanism mounted for rotation about one axis and disposed on the closed side to positively drive both the rounds of ammunition and the respective links during the stripping operation.

Another feature of this invention is the provision of a mechanism for receiving two feeds of linked ammunition and which has two, mutually interlocked, sprocket mechanisms, each disposed on the closed side of a respective feed of linked ammunition, so that one or the other sprocket mechanism is enabled to positively drive both the rounds of ammunition and respective links during the stripping operation of the selected feed of linked ammunition.

DESCRIPTION OF THE PREFERRED EMBODIMENT

Figure 1:
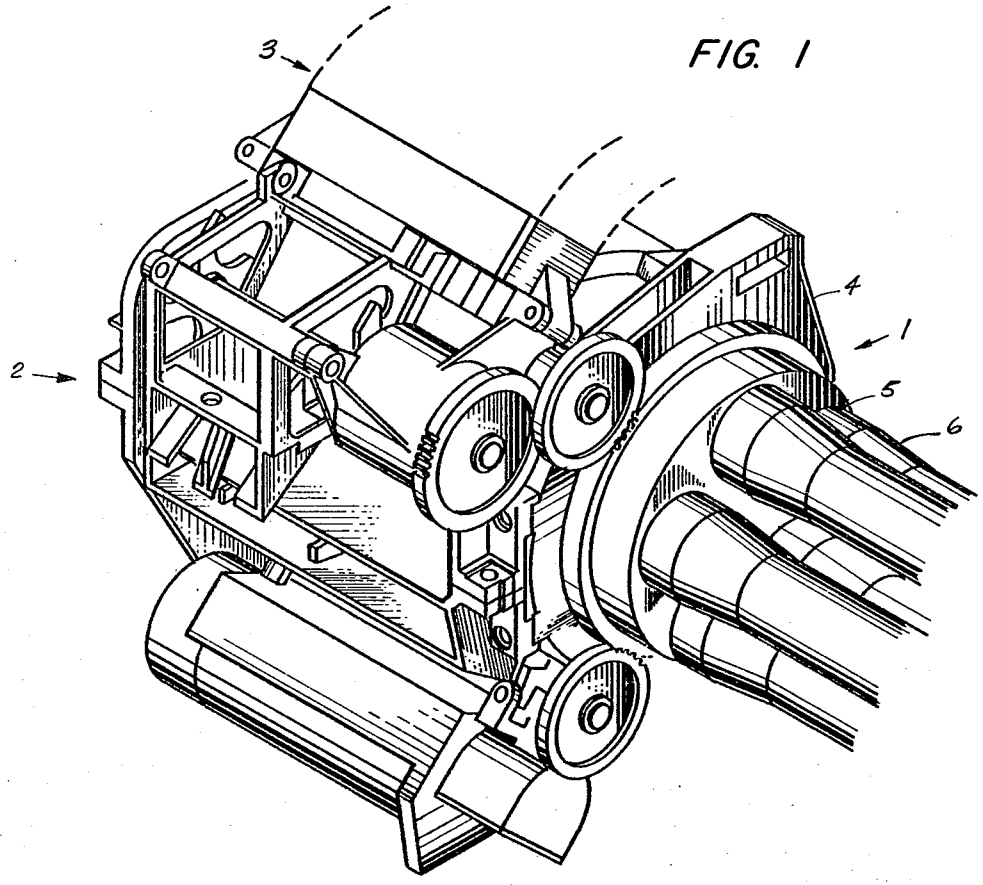
FIG. 1 is a perspective view of a mechanism embodying this invention, for use with a single feed of linked rounds of ammunition, and mounted on a Gatling type gun.
Figure 2:
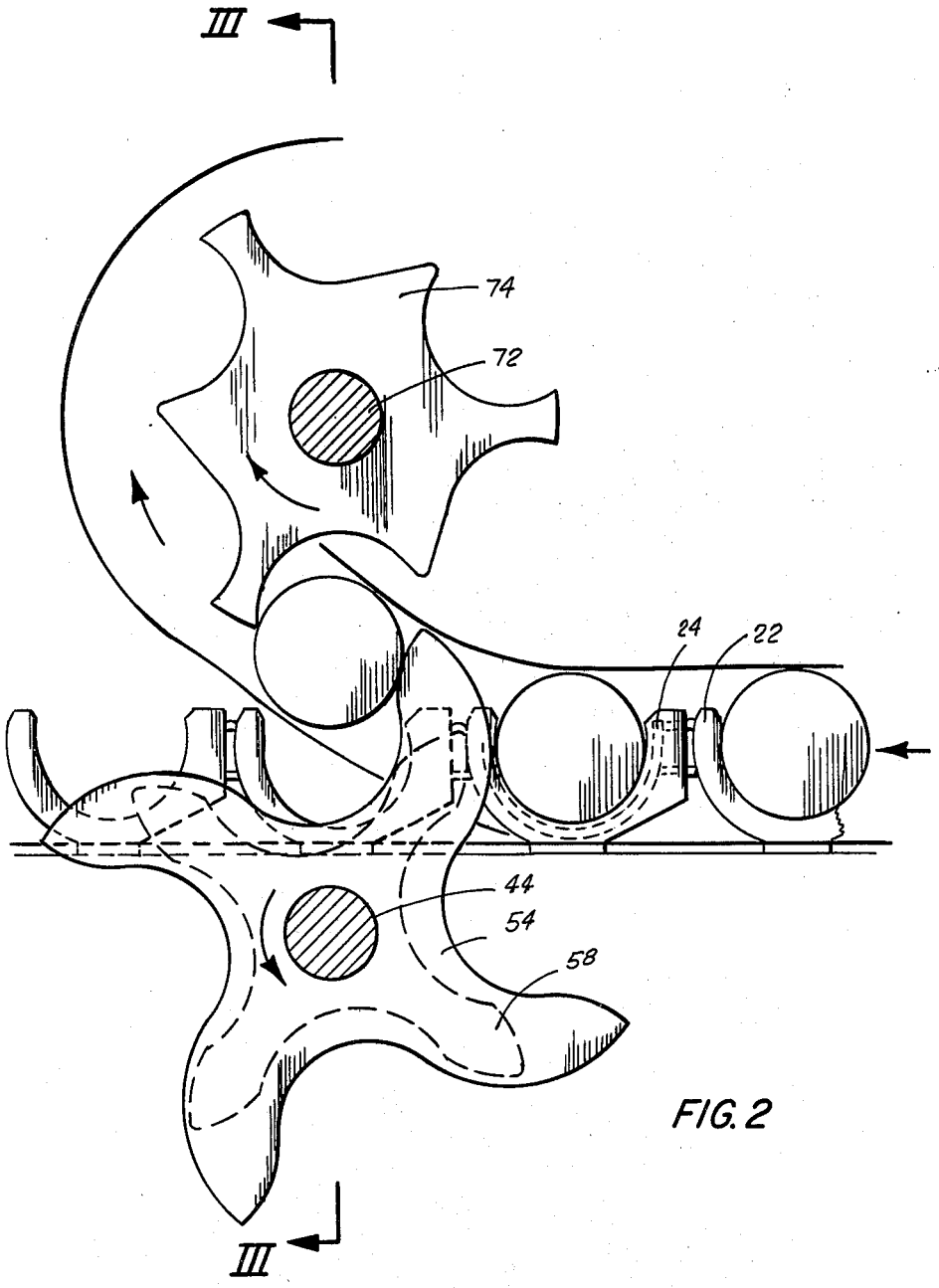
FIG. 2 is a side view in elevation of the principal parts of the side-stripping mechanism of FIG. 1.
Figure 3:
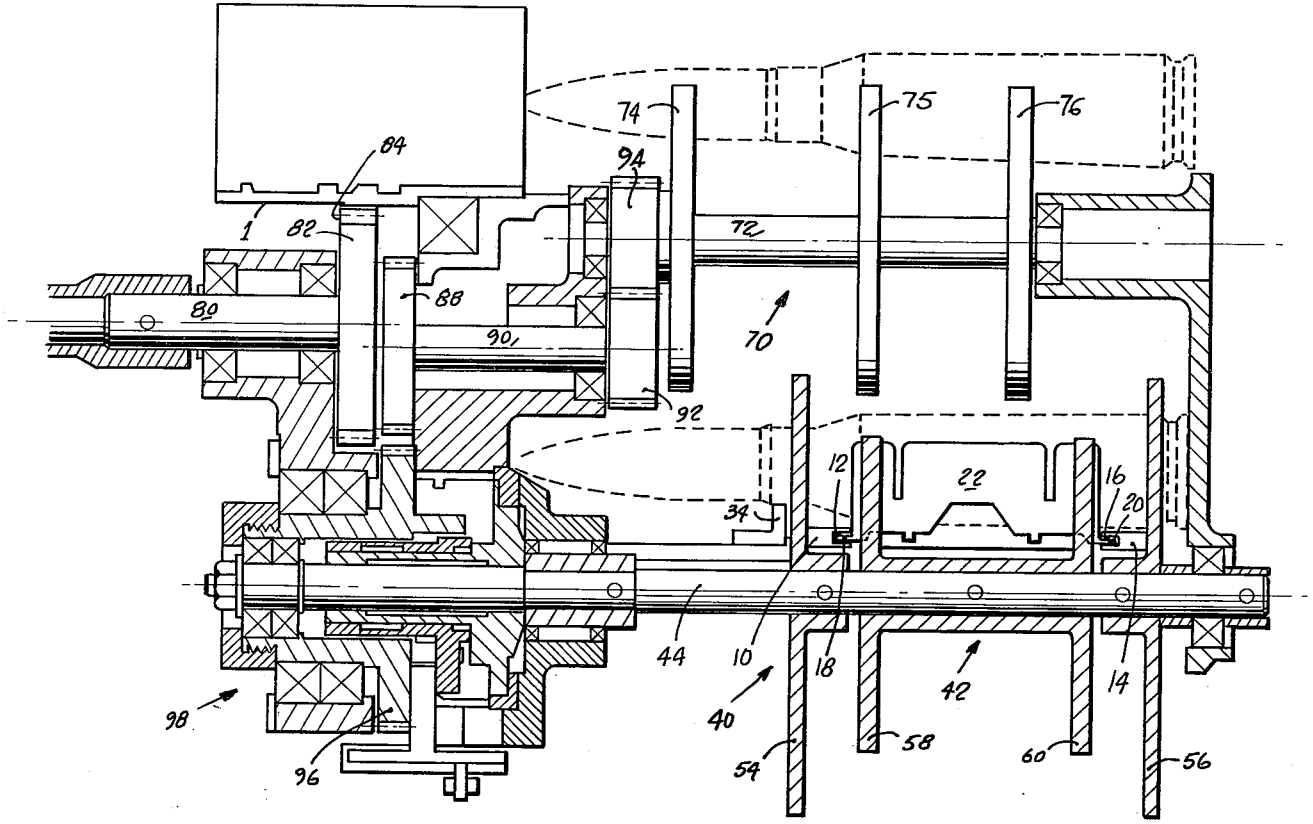
FIG. 3 is a view in cross-section of the mechanism of FIG. 2 taken along the plane III—III.
Figure 4:
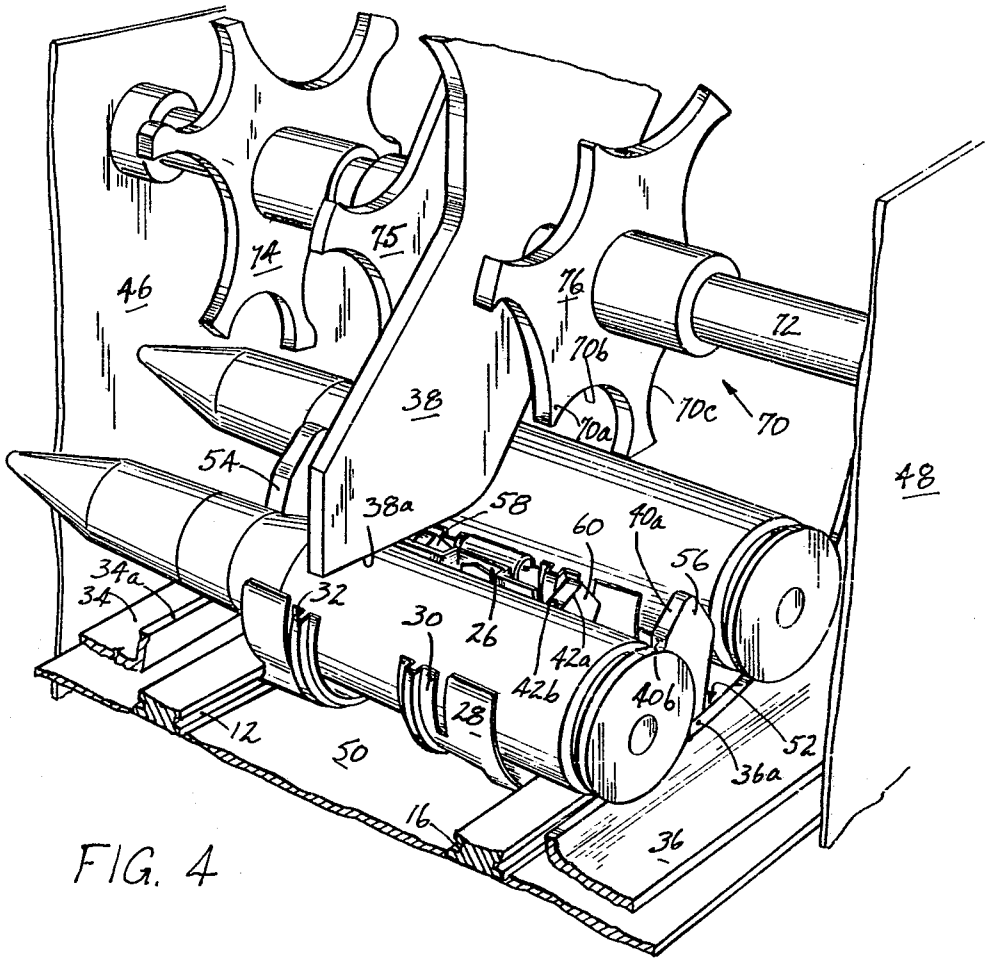
FIG. 4 is a perspective view of the mechanism of FIG. 2.
Figure 5:
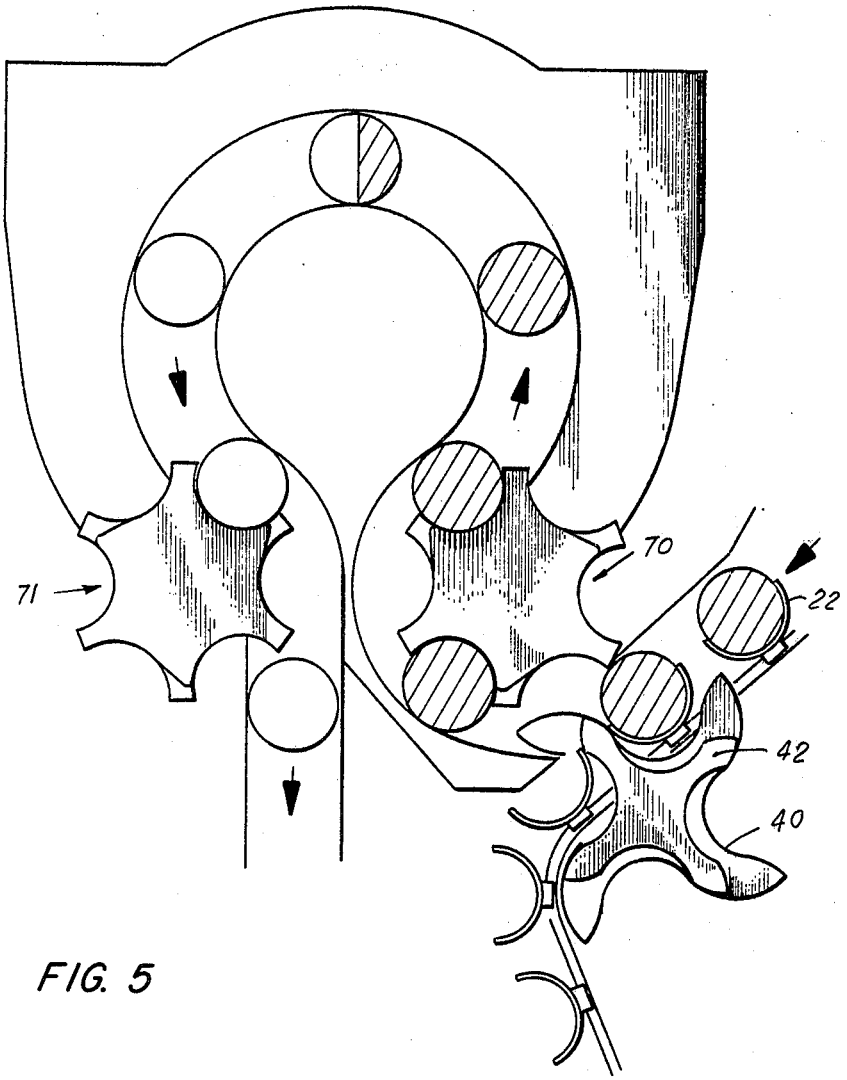
FIG. 5 is a view in cross-section of the mechanism and the gun of FIG. 1 showing the path of the rounds of ammunition.

A Gatling type gun 1 having a side-stripping mechanism 2 fed by a conveyor 3 is shown in FIG. 1. The gun has a stationary housing 4 in which is journaled a rotor 5 to which are fixed a plurality of gun barrels 6. A like plurality of gun bolts are disposed for reciprocation on the rotor for respectively receiving, chambering, and firing rounds of ammunition and for extracting the fired cases.

The side-stripping mechanism 2 of FIG. 1 includes a first guide means comprising a left track 10 having a left slot 12 and a right track 14 having a right slot 16 which respectively receive left and right projecting tabs 18 and 20 of a link 22. Each link comprises a leading portion 24 which snaps onto the cartridge case of a leading round. The leading portion is coupled, for limited pivotal movement, to the saddle 26 of a U-shaped trailing portion 28, which has two spaced apart side portions 30 and 32 which snap onto the cartridge case of the next succeeding round. The leading portion of the next succeeding link snaps onto the cartridge case of said next succeeding round between and under the two spaced apart side portions of the preceding link. Thus each cartridge case has snapped thereon the trailing portion of a preceding link and the leading portion of the next succeeding link. The train of links is constrained to move along the path defined by the slots 12 and 16 by the engagement therein of the tabs 18 and 20.

A second guide means comprises a lower left guide 34 and a lower right guide 36 onto which each cartridge case rides as it is carried along by its respective links. The guide or camming surface 36*a* of the right guide enters into the extractor groove of the cartridge case and thereby precludes movement of the round along its own longitudinal axis, while the guide or camming surface 34*a* of the left guide engages the neck of the case. The camming surfaces 34*a* and 36*a* are initially parallel to the slots 12 and 16, and subsequently rise progressively up away from the slots.

The second guide means also comprises an upper guide 38 under which each cartridge case rides as it is carried along by its respective link. The guide or camming surface 38*a* engages a mid-portion of the case. The camming surface 38*a* is initially parallel to the slots 12 and 16, and subsequently rise progressively up away from the slots. The camming surfaces 34*a* and 36*a* face the camming surface 38*a*, and define a passageway for the cartridge cases which initially, or upstream, is parallel to the path of the links and subsequently, or downstream, diverges from the path of the links.

As described, it will be seen that the train of links has its open side facing upwardly and its closed side facing downwardly.

A round accelerating sprocket 40 and a link pushing sprocket 42 are fixed on a common shaft 44 adjacent the closed side of the train of links. The shaft 44 is journaled to and between a left sidewall 46 and a right sidewall 48. The left track 12, the right track 16, the left guide 34, and the right guide 36 are fixed to a cross plate 50 which is fixed to and between said sidewalls 46 and 48. The plate 50 has an aperture 52 therein through which the teeth of the sprockets 40 and 42 project.

The sprocket 40 comprises a left, four toothed disk 54 and a right, four toothed disk 56. The sprocket 42 comprises a left, four toothed disk 58 and a right, four tooth disk 60.

Each tooth of the sprocket 40 is arcuate in shape, having a distal end portion 40*a* which is adapted to pass between adjacent rounds, and which terminates in a driving face 40*b* which is adapted to bear upon the cartridge case of the leading round. The driving faces of the right disk 56 are adapted to bear on the case immediately to the right, i.e., forward of, the extractor groove. The driving faces of the left disk 54 are adapted to bear on the neck of the case. The driving faces of the disks 54 and 56 are curved. Each curve is so laid out that a line drawn from the point, of contact between the driving face and the case, to the centerline of the case, makes an angle which is preferably 120° or less with a line drawn from the point, of contact between the lower guide 34 or 36 and the case, to the centerline of the case. This angle should be minimized to preclude the case wedging between the lower guide and the accelerating sprocket.

Each tooth of the sprocket 42 has a distal end portion 42*a* which is adapted to pass between adjacent links and has a driving face 42*b* which is adapted to bear upon the side portions 30 and 32 of the trailing portion of the link.

The sprockets 40 and 42 are synchronized in their action and as the sprocket 42 positively translates a link forwardly along the slots 12 and 16, the sprocket 40 positively translates the respective cartridge case forwardly along the lower guide faces 34*a* and 36*a* and progressively withdraws the case from the link.

A load sprocket 70 is fixed on a shaft 72 adjacent the open side of the train of links. The shaft 72 is journaled to and between the left and right sidewalls 46 and 48. The sprocket 70 comprises a left three toothed disk 74, a central three toothed disk 75 and a right three toothed disk 76. Each tooth 70*a* of these three disks is preceded by a cutout 70*b* which is adapted to receive the cartridge case, and is followed by a clearance cutout 70*c*. As a round is stripped out of its respective link by the accelerating sprocket 40, its pitch, with respect to the next succeeding round, is increased, and after it is fully accelerated to the pitch velocity of the load sprocket 70, it is handed off into a cutout 70*b* of the load sprocket 70. The load sprocket 70 continues the translation of the round and places it on the face of one of a plurality of gun bolts which are carried by the rotor of the Gatling type gun. The number of teeth carried by the sprockets 40, 42 and 70 is a function of the desired pitch velocities. The arrangement here shown of four teeth on the sprockets 40 and 42 and three teeth on the sprocket 70 is well adapted for use with a gun having five gun barrels. Other combinations may be used. An unload sprocket 71 withdraws the fired cases from the faces of the gun bolts.

An exemplary Gatling type gun is shown in U.S. Pat. No. 4,342,253, issued Aug. 3, 1982 to R. G. Kirkpatrick et al.

Synchronism between the sprockets 40 and 42 and the load sprocket 72 may be provided by a clutch, such as the cam operated positive clutch and brake shown in U.S. Pat. No. 3,578,118, issued May 11, 1971 to L. K. Wetzel.

In the case of an externally powered gun, primary power is applied to a shaft 80 which carries a gear 82, which directly drives a ring gear 84 on the rotor 1, and through a cluster of gears drives a gear 88. The gear 88 is carried by a shaft 90 which also carries a gear 92 which drives a gear 94 which is carried by the shaft 72 which carries the load sprocket 70. The gear 88, via an idler gear, also drives gear 96 which is fixed to the continuously rotating portion of a clutch 98, whose controlled output rotating portion 100 is fixed to the shaft 44 which carries the accelerating sprocket 40 and the link pushing sprocket 42.

DESCRIPTION OF THE SECOND EMBODIMENT

Figure 6:
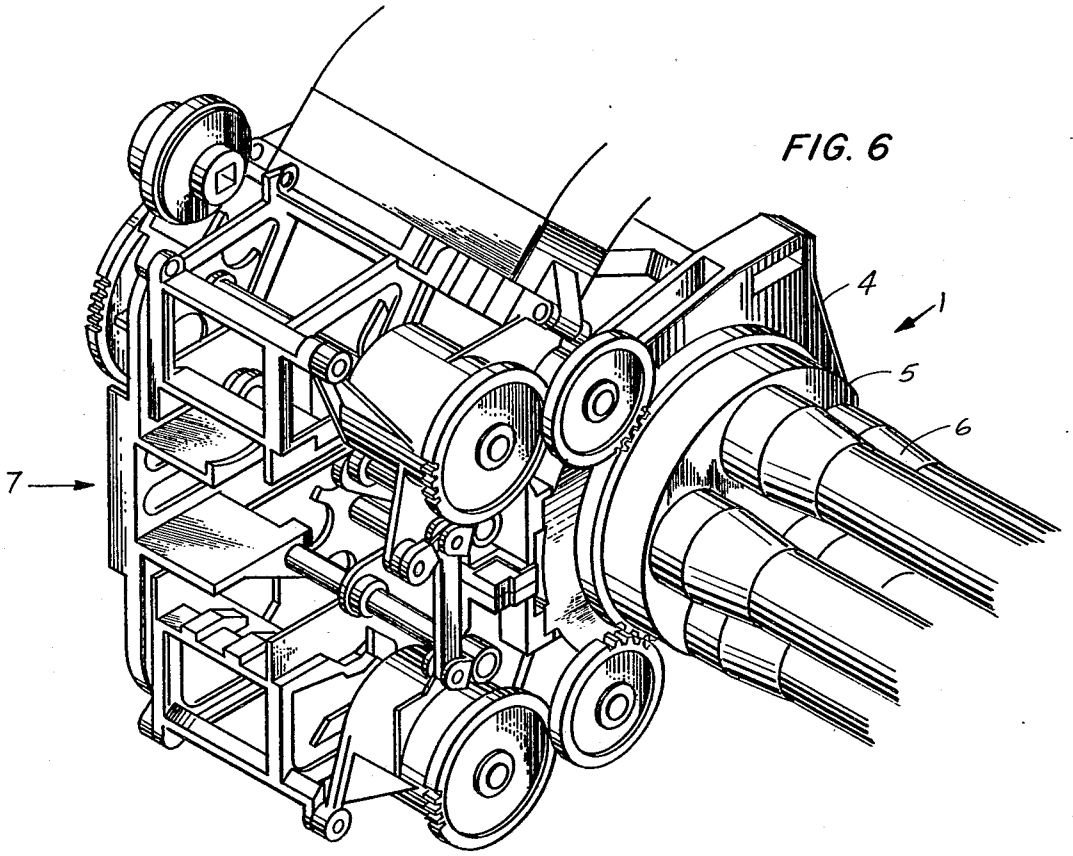
FIG. 6 is a perspective view of a mechanism embodying this invention, for use with a dual feed of linked rounds of ammunition, and mounted on a Gatling type gun.

A Gatling type gun 1 having a dual side-stripping mechanism 7 is fed by two conveyors 7 (and one not visible) is shown in FIG. 6.

The side-stripping mechanism of FIG. 6 includes two of the side-stripping mechanisms of FIG. 1 plus two pairs of clearing gates which are intercoupled by a snap-action or toggle mechanism and actuated by the feed of stripped rounds.

The right hand side-stripping mechanism 100 is identical to the mechanism described with respect to FIG. 1 and includes a right hand round accelerating sprocket 102 and a right hand link pushing sprocket 104 which are fixed on a common shaft 106 adjacent the closed side of the right hand train of links 108 which is guided along a right hand pair of slots 110. A right hand load sprocket 112 receives the rounds during the right hand stripping process and places the rounds on the faces of the gun bolts. A left hand load sprocket 114, serving as a right hand unload sprocket, withdraws the fired cases from the faces of the gun bolts and discharges them down a discharge passageway 116.

A pair of right hand clearing gates, including an aft gate arm 120 adapted to bear on the side of the case adjacent the base, and a forward gate arm, adapted to bear on the neck of the case, are each fixed to a shaft 124 which is journaled to and between the side plates.

A pair of left hand clearing gates, including an aft gate arm 128, adapted to bear on the side of the case adjacent the base, and a forward gate arm, adapted to bear on the neck of the case, are each fixed to a shaft 132 which is journaled between the side plates.

Figure 7:
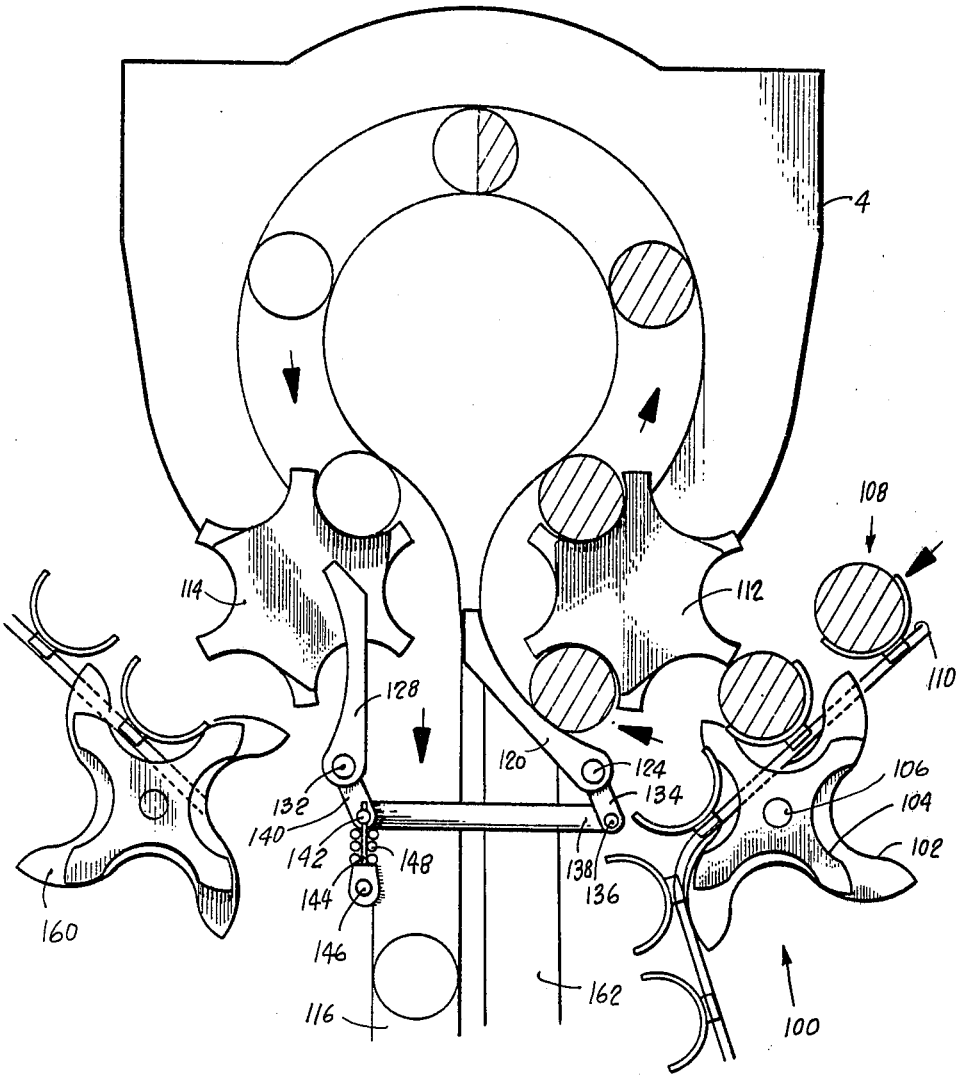
FIG. 7 is a view in cross-section of the mechanism and the gun of FIG. 6 showing the path of the rounds of ammunition.

A link 134 has one end thereof fixed to the shaft 124 and its other end coupled by a pivot 136 to one end of a cross-bar 138. A link 140 has one end thereof fixed to the shaft 132 and its other end coupled by a pivot 142 to the other end of the cross-bar 138. A rod 144 has one end thereof coupled by a pivot 146 to a sidewall and the other end journaled through a diametral bore in the pivot 142. A helical compression spring 148 is disposed on the rod 144 and provides the system of links and the connected thereto gates with a toggle action. In one position of the toggle, as shown in FIG. 7, the right hand gate arms serve as a part of the guide structure forming a passageway for rounds carried by the right hand load sprocket 112 to the gun bolts of the rotor, while the left hand gate arms serve as part of the guide structure forming a passageway for fired cases carried by the left hand load sprocket 114 to the discharge passageway 116. In the other position of the toggle, the left hand gate arms serve as a part of the guide structure forming a passageway for rounds carried by the left hand load sprocket 160 to the gun bolts of the rotor, while the right hand gate arms serve as part of the guide structure forming a passageway for fired cases carried by the right hand load sprocket 112 to a discharge passageway 162. The Gatling type gun here shown is capable of firing in both clockwise and counterclockwise rotation.

While the dual feeder as disclosed herein has utilized a bidirectional Gatling type gun, it will be appreciated that the dual feeder may be modified by the addition of a sprocket which will receive a handoff of stripped rounds from either of the right or left hand load sprockets and which can in turn provide such rounds to a unidirectional Gatling type gun or to a single barrel type gun.

What is claimed is:

1. A side-stripping feeder for linked rounds of ammunition comprising:

first guide means for positively guiding a train of links along a first path with the open sides of the links all facing in a first direction and the closed sides of the links all facing in a second direction;

second guide means for positively guiding a train of rounds of ammunition along a second path which is initially coextensive with said first path and subsequently, at a divergence, diverges from said first path towards said first direction;

first drive means journaled for rotation about a first axis for positively engaging each of the links in sequence adjacent said divergence for positively driving each such link along said first path through said divergence;

second drive means journaled for rotation about said first axis for positively engaging each of the rounds in sequence adjacent said divergence for positively driving each such round along said second path through said divergence and increasing the pitch between each such round and the next succeeding round as it passes through said divergence; and third drive means for positively engaging each of the rounds in sequence at said increased pitch and passing the rounds out of said feeder at said increased pitch.

2. A feeder according to claim 1 wherein:

said first and said second drive means are disposed adjacent to and engage said trains of rounds and links from the closed side of said links.

3. A feeder according to claim 2 wherein:

said third drive means is disposed adjacent to and engages said train of rounds from the open side of said links.

4. A feeder according to claim 1 wherein:

said first drive means is a sprocket disposed for rotation about a first axis which is adjacent the closed side of said links.

5. A feeder according to claim 4 wherein:

said second drive means is a sprocket disposed for rotation about a second axis which is identical to said first axis.

6. A feeder according to claim 5 wherein:

said sprocket of said first drive means and said sprocket of said second drive means are fixed to a common shaft which is journaled for rotation about said first axis.

7. A feeder according to claim 5 wherein:

said third drive means is a sprocket disposed for rotation about a third axis which is adjacent the open side of said links.

8. A feeder according to claim 1 wherein:

said second guide means and said second drive means together serve to increase the pitch of the rounds as they pass through said divergence.

9. A gun and a side-stripping feeder comprising:

a rotor having a plurality of gun barrels and a like plurality of gun bolts;

first guide means for positively guiding a train of links along a first path with the open sides of the links all facing in a first direction and the closed sides of the links all facing in a second direction;

second guide means for positively guiding a train of rounds of ammunition along a second path which is initially coextensive with said first path and subsequently, at a divergence, diverges from said first path in said first direction, first drive means journaled for rotation about a first axis for positively engaging each of the links in sequence adjacent said divergence for positively driving each such link along said first path through said divergence;

second drive means journaled for rotation about said first axis for positively engaging each of the rounds in sequence adjacent said divergence for positively driving each such round along said second path through said divergence and increasing the pitch between each such round and the next succeeding round as it passes through said divergence; and third drive means for positively engaging each such round after it has passed through said divergence for positively driving each such round further along said second path at said increased pitch and for disposing each such round on the face of a respective one, in sequence, of said plurality of gun bolts at said increased pitch.

10. A gun and feeder according to claim 9 wherein: said first and said second drive means are disposed adjacent to and engage said trains of rounds and links from the closed side of said links.

11. A gun and feeder according to claim 10 wherein: said third drive means is disposed adjacent to and engages said train of rounds from the open side of said links.

12. A gun and feeder according to claim 9 wherein: said first drive means is a sprocket disposed for rotation about a first axis which is adjacent the closed side of said links.

13. A gun and feeder according to claim 12 wherein: said second drive means is a sprocket disposed for rotation about a second axis which is identical to said first axis.

14. A gun and feeder according to claim 13 wherein: said sprocket of said first drive means and said sprocket of said second drive means are fixed to a common shaft which is journaled for rotation about said first axis.

15. A gun and feeder according to claim 14 wherein: said third drive means is a sprocket disposed for rotation about a third axis which is adjacent the open side of said links.

16. A gun and feeder according to claim 15 wherein: said second guide means and said second drive means together serve to increase the pitch of the rounds as they pass through said divergence.

17. A feeder according to claim 5 wherein: said second guide means includes a surface upon which each round rides; and said sprocket of said second drive means has a plurality of teeth, each having a distal end portion which is adapted to pass between adjacent rounds, and which terminates in a driving face which is adapted to bear upon the cartridge case of each round in sequence, and which driving face has a curve which is so laid out that a line drawn from the point, of contact between said driving face and the case, to the centerline of the case, makes an angle which is 120° or less with a line drawn from the point, of contact between said surface of said second guide means and said case, to the centerline of said case.

18. A side-stripping feeder for two independent supplies of linked rounds of ammunition comprising:

first guide means for positively guiding a first train of links along a first path with the open sides of the links all facing in a first direction and the closed sides of the links all facing in a second direction;

second guide means for positively guiding a first train of rounds of ammunition along a second path which is initially coextensive with said first path and subsequently, at a first divergence, diverges from said first path towards said first direction;

first drive means journaled for rotation about a first axis for positively engaging each of the links of the first train in sequence adjacent said first divergence for positively driving each such link along said first path through said first divergence;

second drive means journaled for rotation about said first axis for positively engaging each of the rounds of the first train in sequence adjacent said first divergence for positively driving each such round along said second path through said first divergence and increasing the pitch between each such round and the next succeeding round as it passes through said divergence;

third guide means for positively guiding a second train of links along a third path with the open sides of the links all facing in a third direction and the closed sides of the links all facing in a second direction;

fourth guide means for positively guiding a second train of rounds of ammunition along a fourth path which is initially coextensive with said third path which is initially coextensive with said third path and subsequently at a second divergence, diverges from said third path towards said third direction;

third drive means journaled for rotation about an additional axis for positively engaging each of the links of the second train in sequence adjacent said second divergence for positively driving each such link along said third path through said second divergence;

fourth drive means journaled for rotation about said additional axis for positively engaging each of the rounds of the second train in sequence adjacent said second divergence for positively driving each round along said fourth path through said second divergence and increasing the pitch between each such round and the next succeeding round as it passes through said divergence;

control means having a first mode of operation in which said second path is open and said fourth path is blocked, and a second mode of operation in which said second path is blocked and said fourth path is open;

fifth drive means for positively engaging each such round of said first train in sequence at said increased pitch and passing the rounds of said first train out of said feeder at said increased pitch; and sixth drive means for positively engaging each such round of said second train in sequence at said increased pitch and passing the rounds of said second train out of said feeder at said increased pitch.

19. A feeder according to claim 18 wherein: said control means comprises:

a first gate means having a first disposition wherein said second path is blocked by said first gate means, a second disposition wherein said second path is cleared by said first gate means;

a second gate means having a first disposition wherein said fourth path is blocked by said second gate means, and a second disposition wherein said fourth path is cleared by said second gate means; and means interconnecting said first and said second gate means so that when one of said gate means is in its first disposition the other of said gate means is in its second disposition.

20. A side-stripping feeder for two independent supplies of linked rounds of ammunition comprising:

first guide means for guiding a first train of links along a first path with the open sides of the links all facing in a first direction and the closed sides of the links all facing in a second direction;

second guide means for guiding a first train of rounds of ammunition along a second path which is initially coextensive with said first path and subsequently, at a first divergence, diverges from said first path towards said first direction;

first drive means for engaging each of the links of the first train in sequence adjacent said first divergence for positively driving each such link along said first path through said first divergence;

second drive means for engaging each of the rounds of the first train in sequence adjacent said first divergence for positively driving each such round along said second path through said first divergence;

third guide means for guiding a second train of links along a third path with the open sides of the links all facing in a third direction and the closed sides of the links all facing in a second direction;

fourth guide means for guiding a second train of rounds of ammunition along a fourth path which is initially coextensive with said third path and subsequently at a second divergence, diverges from said third path towards said third direction;

third drive means for engaging each of the links of the second train in sequence adjacent said second divergence for positively driving each such link along said third path through said second divergence;

fourth drive means for engaging each of the rounds of the second train in sequence adjacent said second divergence for positively driving each round along said fourth path through said second divergence; and control means having a first mode of operation in which said second path is open and said fourth path is blocked, and a second mode of operation in which said second path is blocked and said fourth path is open;

wherein said control means comprises:

a first gate means having a first disposition wherein said second path is blocked by said first gate means, a second disposition wherein said second path is cleared by said first gate means;

a second gate means having a first disposition wherein said fourth path is blocked by said second gate means, and a second disposition wherein said fourth path is cleared by said second gate means; and means interconnecting said first and said second gate means so that when one of said gate means is in its first disposition the other of said gate means is in its second disposition.

21. A side-stripping feeder for two independent supplies of linked rounds of ammunition comprising:

first guide means for positively guiding a first train of links along a first path with the open sides of the links all facing in a first direction and the closed sides of the links all facing in a second direction;

second guide means for positively guiding a first train of rounds of ammunition along a second path which is initially coextensive with said first path and subsequently, at a first divergence, diverges from said first path towards said first direction;

first drive means journaled for rotation about a first axis for positively engaging each of the links of the first train in sequence adjacent said first divergence for positively driving each such link along said first path through said first divergence;

second drive means journaled for rotation about said first axis for positively engaging each of the rounds of the first train in sequence adjacent said first divergence for positively driving each such round along said second path through said first divergence and increasing the pitch between each such round and the next succeeding round as it passes through said divergence;

third guide means for positively guiding a second train of links along a third path with the open sides of the links all facing in a third direction and the closed sides of the links all facing in a second direction;

fourth guide means for positively guiding a second train of rounds of ammunition along a fourth path which is initially coextensive with said third path which is initially coextensive with said third path and subsequently at a second divergence, diverges from said third path towards said third direction;

third drive means journaled for rotation about an additional axis for positively engaging each of the links of the second train in sequence adjacent said second divergence for positively driving each such link along said third path through said second divergence;

fourth drive means journaled for rotation about said additional axis for positively engaging each of the rounds of the second train in sequence adjacent said second divergence for positively driving each round along said fourth path through said second divergence and increasing the pitch between each such round and the next succeeding round as it passes through said divergence; and control means having a first mode of operation in which said second path is open and said fourth path is blocked, and a second mode of operation in which said second path is blocked and said fourth path is open;

said control means comprising:

a first gate means having a first disposition wherein said second path is blocked by said first gate means, a second disposition wherein said second path is cleared by said first gate means;

a second gate means having a first disposition wherein said fourth path is blocked by said second gate means, and a second disposition wherein said fourth path is cleared by said second gate means; and means interconnecting said first and said second gate means so that when one of said gate means is in its first disposition the other of said gate means is in its second disposition.

* * * * *